United States Patent [19]

Hansen

[11] 4,155,428

[45] May 22, 1979

[54] DEFLECTION CONSTRAINT DEVICE FOR TELESCOPIC UPRIGHTS

[75] Inventor: Howard C. Hansen, Battle Creek, Mich.

[73] Assignee: Clark Equipment Company, Buchanan, Mich.

[21] Appl. No.: 863,822

[22] Filed: Dec. 23, 1977

[51] Int. Cl.[2] ..... B66B 7/02; B66F 9/06

[52] U.S. Cl. ..... 187/95; 187/9 E; 414/670

[58] Field of Search ..... 187/9 E, 73, 80, 92, 187/93, 95; 214/95 R, 670, 730

[56] References Cited

U.S. PATENT DOCUMENTS 3,221,840 12/1965 Weinert ..... 187/9 E 4,015,686 4/1977 Bushnell, Jr. ..... 187/9 E

*Primary Examiner*—Robert B. Reeves

*Assistant Examiner*—Jeffrey V. Nase

*Attorney, Agent, or Firm*—J. C. Wiessler

[57] ABSTRACT

A system for reducing the lateral bending moments and deflection in side loading telescopic uprights, such as for lift trucks. Hydraulic actuated restraint device is mounted between each adjacent pair of upright rails, as well as between the inner rails and fork carriage in a lift truck. The restraint device is energized under controlled conditions, such as when a load on a fork carriage is extended to one side of the upright, to lock together each adjacent pair of upright rails and the fork carriage so as to form a rigid column of each side of the upright.

20 Claims, 6 Drawing Figures

DEFLECTION CONSTRAINT DEVICE FOR TELESCOPIC UPRIGHTS

BACKGROUND OF THE INVENTION

The field of art to which the invention pertains includes elevators, and more specifically portable elevators.

Portable elevators, such as lift trucks, which are adapted for loading both from the front of a telescopic upright and from one or both sides thereof, herein sometimes referred to as "side loading lift trucks," frequently work in very narrow aisles formed by rows of storage racks with barely sufficient side clearance for truck travel. Some such lift trucks are designed so that the upright mast structure may turn about a vertical axis with the load always carried in front of the upright. My invention applies not to the rotating upright type but to those in which the upright is fixedly secured to the truck frame whereby the upright must handle loads both forwardly and to the side thereof.

Conventional lift truck uprights of the front loading type only, are not designed to carry the heavy side loads required of such side loading trucks. Heavy side loads may damage conventional uprights, causing excessive wear rates, premature upright guide roller failures, and sometimes cause elements of the mast structure to bind or "hang-up" while other elements and the hydraulic lift cylinder are lowering. It is important that the various upright elements be able to travel vertically in both directions without sticking or binding.

Heavy side loads also cause conventional uprights to bend and flex excessively in the direction of the side load, particularly at high lift heights. Currently, load lift heights of 480 inches are not uncommon, while lateral deflections of uprights must be minimized for side loading lift trucks. The telescopic members of the mast also wear and spread apart, and even if seizure of the telescopic members do not occur, the mating parts soon have a sloppy relationship with each other. Excessive side deflection also results in lowering the lifting capacity of the truck.

With the advent of side loading lift trucks it became apparent that uprights must be designed for handling heavy side loads at relatively high elevations with minimum side deflection. A number of different design measures have been employed to achieve the required upright rigidity. Among design techniques currently in use are the following:

(1) X-bracing of the various upright sections;

(2) The addition of side thrust rollers at various locations in the upright;

(3) Various forms of cross-over lift chains and supporting cross-over structure. In this regard see U.S. Pat. No. 3,830,342 which discloses relatively complex chain-sprocket arrangements wherein a load carriage or upper mast section is suspended from chains which extend laterally across the truck via sprockets carried by an intermediate mast section and which are tied to a lower mast section. Also see U.S. Pat. No. 3,782,503 which discloses a type of cross-over structure for transferring a portion of a side load to the opposite side of the upright through side mounted stabilizer chains and a transverse torque shaft, and my U.S. Pat. No. 3,716,158 which uses vertical racks and pinions mounted on torque shafts to operatively connect the sides of the upright to the lift carriage for a similar purpose;

(4) The use of additional retainment between upright rails so that the various telescopic members thereof are not extended as much as is common in conventional uprights;

(5) The incorporation of a third set of upright rails oriented for off-setting lateral forces and deflection;

(6) Employing hydraulic lift cylinders at both sides of the upright structure rather than at the center as in conventional uprights; and (7) Straightening and machining the upright rails and imposing exacting tooling and manufacturing tolerances.

SUMMARY

To provide deflection constraint means to reduce lateral bending moments and deflection in side loading telescopic uprights having at least two relatively telescopic upright sections and a load carrier mounted for movement along the upper section, wherein restraining structure is mounted from one upright section and is actuatable into operative holding relation with a portion of the other upright section for rigidifying the relation between the upright sections to reduce side deflection of the upper section relative to the other section under off-center loading of the load carrier. The upright sections are rendered inoperative to telescope during operation of the restraint structure.

It is therefore a primary object of my invention to provide in an otherwise basically conventional telescoping upright structure an improved means by which the telescoping section or sections of the upright react to the torque introduced by side loading thereof so as to greatly reduce the lateral deflection which would normally occur in such an upright under side loading conditions.

Various other objects, advantages and features of the invention will become apparent from the following description and accompanying drawings.

DESCRIPTION OF THE PREFERRED EMBODIMENT

Figure 1:
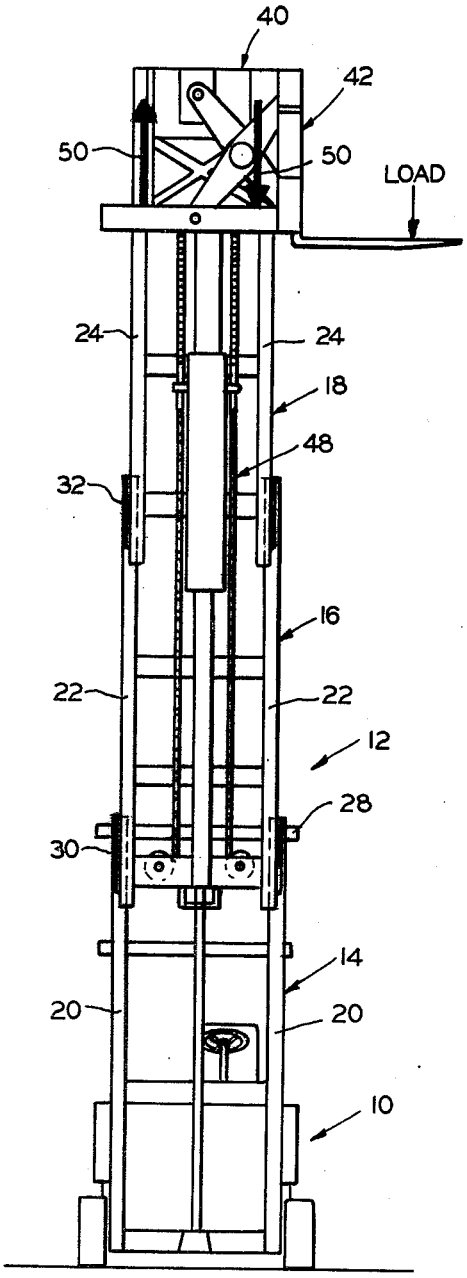
FIG. 1 is a front elevational view of a lift truck having a triple stage upright at full extension with a fork carriage supporting a load at one side thereof.

Referring to FIGS. 1–4, a conventional lift truck is shown at numeral 10 on which is mounted from the front end a basically conventional triple stage, full free-lift upright structure, such as is disclosed in detail in U.S. Pat. No. Re. 27731; it has mounted thereon a side loader fork attachment, such as is disclosed generally in my aforementioned U.S. Pat. No. 3,716,158 and in detail in my U.S. Pat. No. 3,762,588.

The upright assembly is illustrated generally at numeral 12, it being mounted on the truck in known manner. It comprises essentially three mast sections 14, 16 and 18 having, respectively, a pair of spaced vertically fixed channel rails 20, a pair of spaced telescopic intermediate nested I-beam rails 22, and a pair of spaced inner telescopic I-beam rails 24, each pair of rails being secured together by a plurality of suitable transverse brace members as shown.

The inner I-beam mast section 18 is nested within intermediate mast section 16 such that the forward flanges of I-beams 24 are disposed outside of the forward flanges of I-beams 22, and the rearward flanges of I-beams 24 are disposed within the adjacent channel portions and forwardly of the rearward flanges of I-beams 22, pairs of upper and lower rollers being suitably mounted between said adjacent pairs of nested I-beams 22 and 24 for supporting each of the I-beams 24 for extensible movement relative to the adjacent I-beam 22, all in known manner. Similarly I-beams 22 of mast section 16 are nested in channel rails 20 of fixed mast section 14 for telescopic movement outwardly thereof, as shown, upon similar sets of rollers which support I-beams 22 longitudinally and laterally relative to channel beams 20. Cut-outs are provided as is usual in such an upright construction in certain top and bottom flange portions of the I-beams and channel rails, which appear in FIGS. 1, 3 or 4 at the upper ends of rails 20 and 22 at numerals 30 and 32 and in the lower ends of the flange portions of rails 22 and 24 at 34 and 36, as is conventional and as is described in part in U.S. Pat. No. Re. 27731 and in detail in U.S. Pat. No. 3,213,967, to provide for the mounting of relatively large diameter guide and support rollers which extend through the respective cut-out flange portions and are mounted adjacent the top and bottom of the rails of the respective mast sections. In order to implement my invention certain of the above flange cut-out portions have been modified from the conventional structure by substantially lengthening the cut-outs to provide a location for mounting my deflection constraint means, as will appear below.

Figure 2:
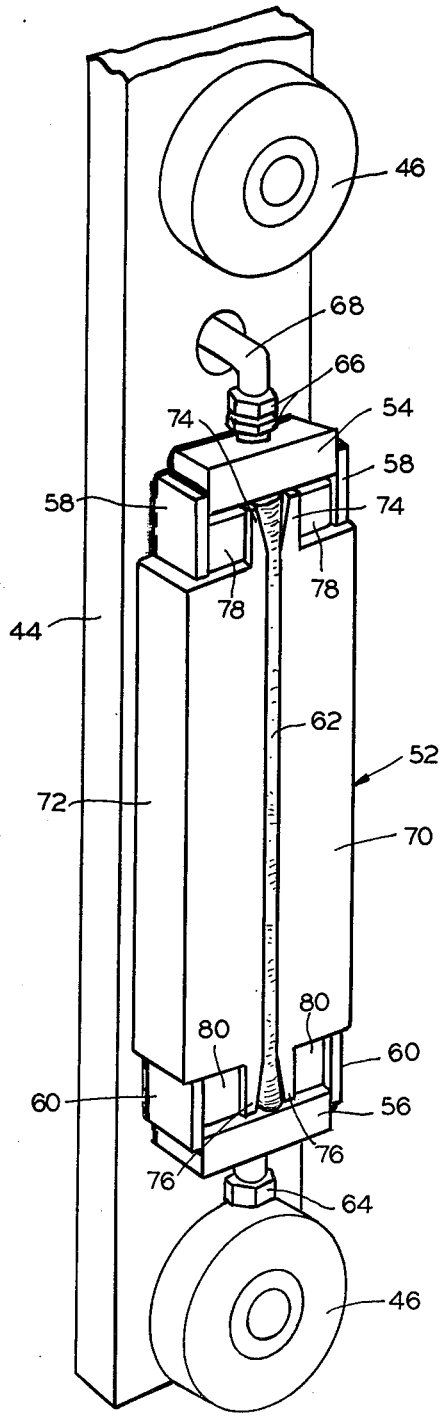
FIG. 2 is a partial view in perspective of one of a pair of transversely spaced fork bars which support the fork carriage for elevation in the inner telescopic member of the upright, on which fork bar my deflection constraint means is mounted.
Figure 4:
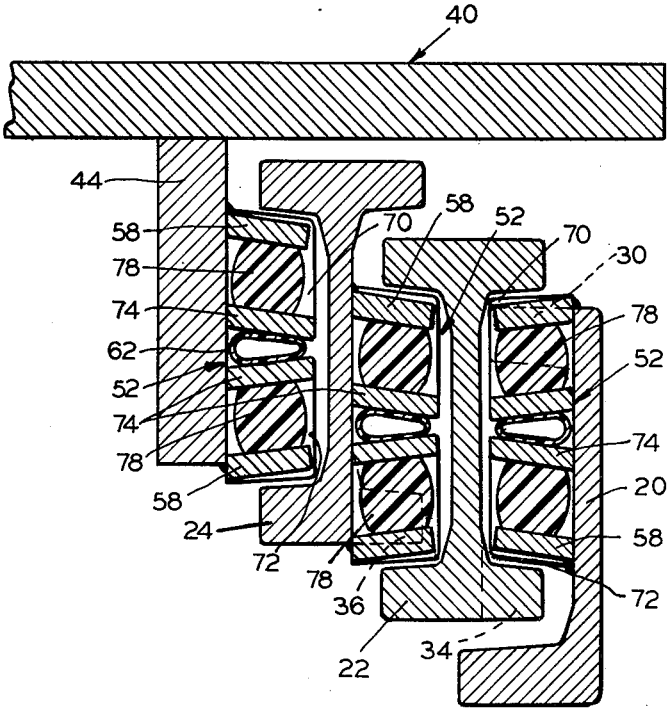
FIG. 4 is a special cross-sectional view to be described of the right hand side of the upright shown in FIG. 1.

A load carriage 40 which carries a rotatable and extensible side loading attachment 42 is mounted in well known manner forwardly of the upright assembly, having a pair of transversely spaced fork bar members supporting the fork carriage and attachment by pairs of support and guide rollers in the inner channel portions of I-beam rails 24, the guide rollers being supported from the usual pair of transversely spaced fork bar members, one of which is shown in FIGS. 2 and 4 at 44, a pair of the carriage guide rollers being shown in FIG. 2 at 46.

A multiple cylinder telescopic hydraulic ram assembly is shown fully extended at 48 for elevating the upright from a collapsed position wherein the fork is located at floor level to a maximum elevation as shown in FIG. 1, all as described in detail in U.S. Pat. No. Re. 27731.

It will be understood that the description thus far relates to an exemplary telescoping upright, side loading lift attachment and lift motor means with which my invention is associated, as described below, but which is merely exemplary of one kind of upright structure and assembly with which my invention may be used.

In a conventional triple stage upright, for example, fork carriage rollers impose a torque on the inner rail as a horizontal force couple under a side loading condition. Conventionally being of poor design for absorbing side forces, the inner stage deflects in the direction of the load. Similarly, substantially horizontal force couples exist as between the inner and intermediate stages, and between the intermediate and outer fixed stages of the upright. Such resulting horizontal forces cause many problems discussed above under the assumed conditions. Such horizontal torque couples essentially cause the various problems associated with side loading lift trucks. If the upright design can be designed to counteract the horizontally oriented torque couples with vertically oriented force couples, a conventional upright structure can be made capable of handling substantial side loads with greatly reduced lateral deflection.

A vertically acting force couple is represented by arrows 50 in FIG. 1 to illustrate the resultant function of my invention which converts the usual horizontal force couples in a side supported load to a vertically oriented force couple. As will appear in detail below, the individual rails of the upright sections are adapted to be clamped together with very substantial force, so that the individual telescoped rails 20, 22 and 24 on each side of the upright function together as a single rigid column. Thus, the two forces comprising the vertically oriented force couple 50 are essentially aligned with the vertical rails so that the right hand column comprising the rails 20, 22 and 24 as seen in FIG. 1 is subjected to a compressive load and the left hand column comprising the similarly numbered rails on the opposite side of the truck is subjected to a load in tension. Thus, the upright assembly functions essentially as a single cantilevered truss, as will become apparent from the description which follows.

In the upright structure as shown in FIG. 1 I utilize six different locations for installation of my deflection constraint means, one between each pair of adjacent rails on each side of the upright, and one between each side of the inner rails 24 and the adjacent fork bar 44. In FIG. 2 a deflection constraint assembly 52 is shown mounted from the outer side of the one fork bar 44 intermediate the guide rollers 46. It comprises upper and lower shear blocks 54 and 56 which are secured, as by welding, to fork bar 44. Upper and lower pairs of depending plate members 58 and 60 are secured to the fork bar and to the shear blocks, as shown. A length of hydraulic hose 62 extends vertically between the shear blocks, the lower end extending downwardly through an opening in lower block 56, which terminates in a sealed end cap 64, and the upper end of which extends through an opening in block 54 which is connected by standard hydraulic fittings 66 to an external hydraulic pressure source by hose 68. The hose is preferably a plastic type such as "Synflex" hose.

A pair of vertically extending restraint members 70 and 72, preferably generally rectilinear in cross-section, each has upper and lower projecting tabs 74 and 76 and are inserted between upper and lower blocks 54 and 56 so that the back surfaces of members 70 and 72 are in contact with hose 62. Assembled intermediate the pairs of projecting members 74 and 58 are a pair of compression pads 78, which may be of a relatively hard rubber or neoprene material; likewise, a pair of similar compression pads 80 are located between pairs of extensions 60 and 76.

In assembling the restraint means 52, members 70 and 72 may be clamped together by any suitable external clamping means with sufficient force to substantially flatten hose 62 along its length, as shown, at which time the pairs of compression pads 78 and 80 may be inserted between the respective pairs of extension members 58, 60, 74 and 76, whereupon the external clamping force is removed and the non-pressurized or empty hose forces members 70 and 72 a small distance apart causing the compression pads to compress a small amount until reaching equilibrium. When pressure fluid is admitted into the hose it, of course, expands to attempt to assume a normal circular cross-section which forces members 70 and 72 apart further compressing pads 78 and 80. The restraint device functions in essence like a hydraulic brake in a holding mode, application of pressure causing members 70 and 72 to move apart to perform a restraining or brake holding function. The outer surfaces of members 70 and 72 may be provided with bonded or riveted brake shoe material. Venting hydraulic pressure permits the compression pads to expand which causes members 70 and 72 to retract and again collapse hose 62 as shown.

Of course, a similar restraint assembly is installed between the carriage rollers on the opposite fork bar 44, and both restraint means are connected to the same pressure source and to a hydraulic control system to be described so that the pair of constraint means are applied simultaneously to lock the carriage rigidly to the inner rails 24 during side loading operations.

Figure 3:
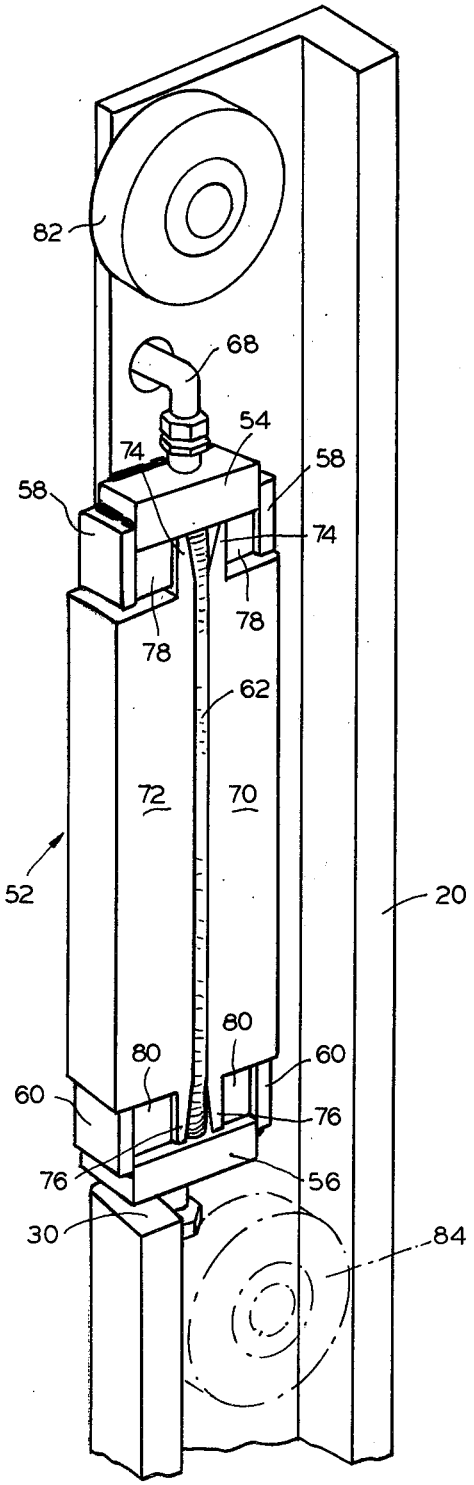
FIG. 3 is a partial view in perspective of my constraint means as shown in FIG. 2 but mounted upon one of a pair of outer fixed upright rail sections.

FIG. 3 illustrates another restraint means assembly as in FIG. 2 for installation in each outer rail 20. In this case the assembly is installed adjacent and below an upper guide roller 82 mounted on each of the channel rails. The elongated cut out flange portion 30 in each front flange of the rails 20 provides not only for roller 82, as is usual, but also allows for the installation of the restraint assembly adjacent and below each roller 82 as shown. The restraint device 52 mounted from the web of each outer rail channel 20 protrudes through the respective cut-out 30 into the respective I-beam rail 22. The lower guide roller which is mounted on each intermediate I-beam rail 22, one of which is shown in phantom view at 84, is shown in FIG. 3 located in relation to the restraint device at the maximum elevation of FIG. 1. It approaches but never interferes with the restraint device. The rail retention at maximum elevation between rails 20 and 22 is illustrated by the distance between the centers of rollers 82 and 84 in FIG. 3.

In a similar manner, a restraint assembly 52 is mounted adjacent the bottom of each rail 24 adjacent and above the bottom guide roller; when actuated it locks and rigidifies the relationship between rails 22 and 24 on each side of the upright.

In FIG. 4, in order to exemplify in one view the three restraint devices on one side of the upright, the sectional view is taken on one side just below the shear blocks 54 on the carriage fork bar 44 and on the outer and intermediate rails 20 and 22 at any given upright elevation. In view of the clarifying purpose of FIG. 4, none of the other upright components are illustrated.

It will be noted that the one restraint assembly as shown in FIG. 2 is nested between the flanges of inner rail 24 forming the inner channel section thereof such that pressurization expands hose 62 as aforesaid to force elements 70 and 72 with substantial force into contact with the adjacent flange portions of rail 24, whereby to rigidify the columnar relationship between each side of the fork carriage and each rail 24 at the upper end thereof. Likewise, the assembly 52 which is mounted near the lower end of the outer channel portion of each rail 24 when energized expands outwardly into forcible contact with the inner surfaces of the inner flange portions of each rail 22, whereby to rigidify the columnar relationship between each pair of rails 22 and 24 adjacent the upper ends of rails 22 at maximum elevation. The same rigid columnar relationship is obtained by energization of the assembly 52 as shown in FIG. 3 as between each outer fixed rail 20 and the inner surfaces of the outer flange portions of the adjacent intermediate rail 22 near the bottom end thereof at maximum elevation. It will therefore be seen that each side of the upright at maximum or any elevation forms a rigid column when the six restraint devices are actuated. At maximum elevation as in FIG. 1 each intermediate rail 22 is rigidly connected near both the top and bottom thereof to both adjacent rails 24 and 20, while a similar relationship is present between each side of the fork carriage and each adjacent rail 24.

Each pair of extensions 58 and 60 are mounted in a manner to extend in slight converging relation from the secured ends thereof, the upper pairs of extension tabs 58 being shown in FIG. 4. Likewise, the pairs of projections 74 and 76 of restraint members 70 and 72 extend in similar converging relation, elements 74 being shown in FIG. 4. This design feature assures that inasmuch as pairs of compression pads 78 and 80 are always in at least preloaded compression, that the convergence of the said extensions causes the forces of compression to retain hoses 62 and the restraint blocks 70 and 72 against or immediately adjacent the surface on which each restraint assembly is installed, viz, the respective fork bar 44, the web of I-beam rail 24, and the web of channel rail 20. Consequently, these components of each restraint assembly tend to bulge inwardly and toward rather than outwardly and away from the said respective surfaces on which they are installed. Consequently all of the parts of each restraint assembly which diverge towards the surface on which the assembly is installed, including compression blocks 78 and 80 which are in contact with such parts, are prevented from working outwardly and away from any other parts of the assembly.

Operating clearance is provided between each pair of restraint members 70 and 72 and the adjacent blocks 54 and 56 so that the members 70 and 72 may move readily outwardly against the inner surfaces of the flanges of the rail channel into which they protrude upon pressurization of the hoses, and are free for ready retraction by the compression blocks. Members 70 and 72 are mounted so as to have vertical operating clearance with shear block members 54 and 56, whereby a small vertical displacement of members 70 and 72 is allowed.

In operation, as will now be apparent, rigid structural columns are formed at each side of the upright by the side rail assemblies and the fork carriage whenever restraint devices 52 are pressurized to actuate. Thus, an extremely rigid upright even at maximum elevation with a load fully extended to one side thereof, as illustrated in FIG. 1, is provided by the generation of a vertically oriented resultant force couple, such as previously described with respect to couple 50. A relatively simple and low cost means is thus provided for installation in otherwise conventional upright structure which vastly improves upon anything available in the prior art for the purpose intended.

Figure 5:
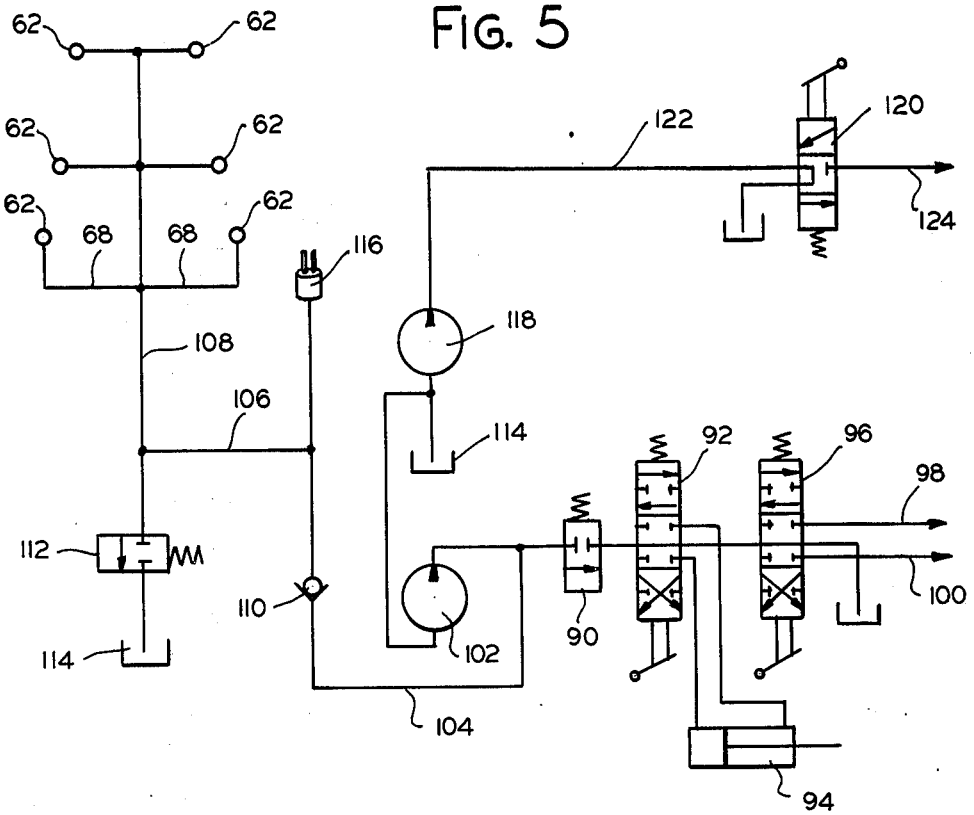
FIG. 5 is a schematic diagram of a portion of a hydraulic system of a side loading lift truck utilizing my invention.

A hydraulic control system for the constraint system is shown in FIG. 5. A solenoid control valve 90 is spring-loaded to a normally closed position. Operator's directional control valve 92 is of an open-center spool type which is adapted to control a double-acting cylinder 94 for extending the side loading attachment 42 to the side of the upright, such as in FIG. 1, while a similar type directional control valve 96 is adapted to control via conduits 98 and 100 both means for rotating the side loader attachment from one side to the other of the upright and an auxiliary lift and lower actuator of said attachment 42. Operation of the control handle in either direction of either control valve 92 or 96 closes a circuit to operate an auxiliary pump 102 which pressurizes the six upright restraint devices 52 via conduits 104, 106, 108 and 68, and a check valve 110. With valve 90 in its normally closed condition and a normally closed solenoid operated poppet valve 112 closing line 108 to a reservoir 114, the pump 102 pressurizes the dead end circuits of hoses 62, which following a predetermined pressure rise activates a pressure switch 116 which energizes the solenoid of valve 90 causing it to open. Pressure fluid at a selected pressure, such as 2.000 psi, if, of course, trapped in the upright restraint devices when valve 90 opens by check valve 110 and valve 112.

Following opening of valve 90 by pressure switch 116 auxiliary pump 102 may be utilized to operate via operator control valves 92 and 96 all of the functions of the side loader attachment while the upright restraint or brake devices 52 maintain all other elements of the upright in a rigid locked condition as previously described, whereby the side loading functions may be performed with minimum deflection of the upright as shown in FIG. 1.

A main pump 118 supplies pressure fluid through an operator's directional control valve 120 and conduits 122 and 124 to lift cylinder motor 48. Whenever lift-lower valve 120 is manipulated in either direction micro switches in a circuit, not shown, which activates solenoid valve 112 causing valve 112 to open and rapidly evacuate to reservoir 114 the pressure fluid in all of brake or restraint devices 52, thereby causing the restraint devices to unlock the upright sections and the load carriage so that lift and lowering operations of the upright can proceed. Return of valve 120 to neutral, as shown, opens the said micro switches allowing valve 112 to return to its normally closed condition, whereby the hydraulic circuit to the restraint devices is again in condition to be activated by manipulation of either valve 92 or 96.

When the elements of the upright are in a locked condition it will be apparent that the side loading attachment would be unable to move vertically to pick-up or deposit a load. Therefore, an auxiliary lift and lower feature is provided in the attachment, not shown, enabling the side loader attachment to lift and lower a small distance solely for the above purpose. Such auxiliary lift devices are generally known in the art, do not form a part of this invention, and need not be disclosed herein. However, as mentioned above, operation of valve 96 conditions an auxiliary lift-lower circuit in conduit 100 downstream of the valve to operate the restraint devices prior to operation of the auxiliary lift-lower means via a normally closed solenoid operated valve, not shown, In general, restraint devices 52 are operated to lock-up the upright sections prior to operation in any mode of the side loader attachment, the upright remaining in a locked-up condition during functioning in any mode of the side loader and until automatic release of the restraint devices by initiation of operation of lift cylinder motor 48.

Figure 6:
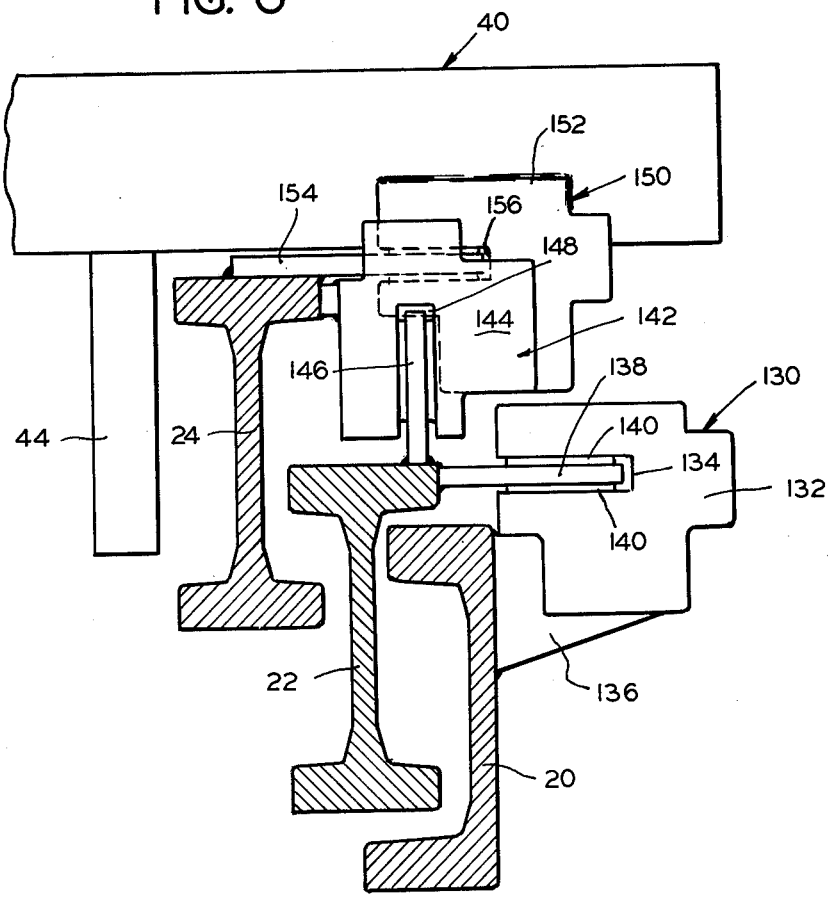
FIG. 6 is a partial plan view of one side of an upright in which a modification of my invention is shown.

Although the foregoing describes a preferred embodiment of my invention, alternative embodiments are within the scope of the invention, and an exemplary second embodiment thereof is shown in FIG. 6 wherein one side only of an upright similar to that shown in FIG. 1 taken across a section similar to that shown in FIG. 4 is illustrated, it being understood, of course, that the structure is duplicated on the opposite side of the upright.

In substitution of restraint means 52 there is disclosed a modified form of restraint means operatively connecting each respective pair of rails and the inner rail to the load carriage which are of a structure similar to caliper-type brake means. A caliper-type brake restraint assembly 130 comprising a brake element 132 having a slot 134 is secured by a bracket 136, as by welding, to the outer surface of the web of fixed channel rail 20 adjacent the upper end thereof, the upright rails and load carriage being numbered the same as previously, and the known guide rollers and flange cut outs of the rails being not shown. A metal strip 138 having opposite side surfaces bonded with a brake pad material 140 is secured to the outer edge of the forward flange of I-beam rail 22 and extends into slot 134. A second restraint unit 142 is similar to unit 130, having a brake element 144 secured to the outer front flange or rail 24 adjacent the bottom end thereof, and a brake pad lined metal strip 146, which is welded to the front surface of rail 22, extending into a slot 148. A third restraint unit 150 is similar to the above described units and has the body 152 thereof secured, as by welding, to an adjacent transverse support member of load carriage 40, and a brake pad lined metal strip 154, which is welded to the front surface of rail 24, extending into a slot 156.

Such restraint units as are shown in FIG. 6 may be of the caliper-type which have been used in some automotive brakes, and, as is known, include hydraulic pistons, not shown, mounted in the body of each unit for actuation into braking relationship with the brake pads on each of the metal strips which extend into the respective slots. A hydraulic system as disclosed in FIG. 5 may be utilized for the purpose of controlling the restraint units of FIG. 6.

Actuation of the restraint units 132, 142 and 150 under the conditions described above in respect of FIG. 5 will effect at the selected elevation of the load carriage 42 a rigid, deflection resistant connection between the respective pairs of rails and between inner rail 24 and fork carriage 40 on each side of the upright, thereby effecting a relatively rigid column as between the rails at each side of the upright supporting a side deflection resistant attachment 42, all as described in detail above.

As will be apparent to persons skilled in the art such restraint units as are shown in FIG. 6 can be designed into the upright rail system in other ways than the particular manner disclosed to accomplish the objectives hereof.

It will be understood, of course, that my invention is applicable to essentially any form of telescopic upright having two or more stages. In respect of my preferred embodiment the upright sections should be related in such a manner that there are adjacent surfaces of each pair of upright rails to which the deflection restraint means can be applied. For example, in addition to the form of upright disclosed herein, the preferred embodiment is applicable to non-roller mounted slider type uprights, uprights known as a "J-section" type, an I-section upright in with the I-beams are wholly nested within an adjacent rail section contrary to the offset mounted I-beam rails as disclosed herein, and any other form of telescoping upright sections in which the criteria of adjacent surfaces is present. In respect of the embodiment of FIG. 6 the criteria of adjacent surfaces is not required, as will be apparent, so that FIG. 6 would also be applicable to, for example, roller mounted channel rails such as are disclosed in U.S. Pat. No. 2,759,562.

Although I have described and illustrated preferred embodiments of my invention, it will be understood by those skilled in the art that modifications may be made in the structure, form and relative arrangement of parts without departing from the spirit and scope of the invention. Accordingly, it should be understood that I intend to cover by the appended claims all such modifications which fall within the scope of my invention.

I claim:

1. In an upright assembly having a first upright section, a second upright section mounted in telescoping relation to said first upright section and a load carrier mounted for movement along said second section, fluid actuated restraint means mounted from one of said sections actuatable into operative holding relation with a portion of the other said section for rigidifying the relation between said sections to reduce side deflection of said second section relative to said first section under off-center loading at said load carrier in relation to said upright sections, said sections being non-operable to telescope during such operation of said restraint means, and means for releasing said restraint means from said holding relation to permit such telescopic movement.

2. An upright assembly as claimed in claim 1 wherein second fluid actuated restraint means is mounted from said load carrier and is actuatable into operative holding relation with a portion of the second upright section for rigidifying the relation between said load carrier and said second section to reduce side deflection of said load carrier relative to said second section under said off-center loading at said load carrier, said load carrier being non-operable to move along said second section during such operation of said second restraint means, said means for releasing said restraint means being also operative to release said second restraint means from said holding relation to permit load carrier movement along said second section.

3. An upright assembly as claimed in claim 1 wherein said first and second upright sections include opposed and nested channel portions, and said restraint means comprises hydraulic actuated elements actuatable into said holding relation.

4. An upright assembly as claimed in claim 1 wherein said restraint means includes hydraulically actuated brake elements.

5. An upright assembly as claimed in claim 4 wherein hydraulic hose means is pressurized to expand and actuate said brake elements into said holding relation.

6. An upright assembly as claimed in claim 1 wherein guide roller means mounts said second upright section in said first upright section and said restraint means is mounted on said first section below upper guide roller means mounted thereon.

7. An upright assembly as claimed in claim 1 wherein said second section is of an I-beam configuration mounted in nested relation with said first section, an elongated cut-out in a flange portion of one of said sections enabling said restraint means to be actuated through the opening formed by said cut-out into holding relation with an overlapping flange of the other said section.

8. An upright assembly as claimed in claim 7 wherein said restraint means includes a pair of brake elements hydraulically actuatable into holding relation with both opposed flange portions of the upright section other than the section on which the restraint means is mounted.

9. An upright assembly as claimed in claim 1 wherein said restraint means is mounted adjacent one end of said one of said sections, and hydraulic control means for actuating said restraint means to effect a relatively rigid column at each side of said upright sections only under a predetermined condition of operation of said load carrier.

10. An upright assembly as claimed in claim 1 wherein said restraint means comprises flexible hydraulic hose means intermediate a pair of brake elements mounted for actuation into said holding relation upon pressurization of said hose means, and hydraulic control means operative only under preselected conditions of operation of said load carrier to actuate said restraint means.

11. An upright assembly as claimed in claim 1 wherein said restraint means is operable at any selected elevation of the upright assembly.

12. In an upright assembly having a first upright section and a second upright section mounted in telescoping relation to said first upright section, restraint means mounted operatively between said upright sections and actuatable into operative holding relation so as to rigidify the relation between said upright sections under predetermined conditions, said sections being non-operable to telescope during such operation of said restraint means, said restraint means including hydraulic means operable under predetermined conditions to thus rigidify said upright sections to form a relatively rigid column at each side thereof when telescoped outwardly.

13. An upright assembly as claimed in claim 12 wherein said restraint means comprises caliper-like brake means between said upright sections having elements thereof mounted from each said section actuatable to hold one such element relative to the other element and thus rigidify the relation between said sections.

14. An upright assembly as claimed in claim 12 wherein said restraint means is mounted from one of said sections and is actuatable into said operative holding relation with a portion of the other said section.

15. An upright assembly as claimed in claim 12 wherein said restraint means is operable at any selected elevation of the upright assembly.

16. In an upright assembly having a first upright section, a second upright section mounted in telescoping relation to said first upright section, a third upright section mounted in telescoping relation to said second upright section and a load carrier mounted for movement along said third section, fluid actuated means mounted from certain of said upright sections and from said load carrier actuatable into operative holding relation with portions of certain other of said upright sections for rigidifying the relation between said first, second and third upright sections and between said load carrier and said third upright section to reduce side deflection of the upright assembly during side loading at said load carrier, said sections being non-operable to telescope and said load carrier being immovable along said third section during such operation of said restraint means, and means for releasing said restraint means from said holding relation to permit such telescoping of said upright sections and movement of said load carrier.

17. An upright assembly as claimed in claim 16 wherein said restraint means is mounted from the upper end portion of said first section, the lower end portion of said third section, and from said load carrier.

18. An upright assembly as claimed in claim 16 wherein said upright sections have nested flange portions and said restraint means is actuatable into holding relation with the flange portions of an adjacent upright section.

19. An upright assembly as claimed in claim 18 wherein said restraint means includes brake elements hydraulically actuatable into said holding relation, and hydraulic control means operable prior to said off-center loading at said load carrier to pressurize said restraint means.

20. An upright assembly as claimed in claim 16 wherein said restraint means is operable at any selected elevation of the upright assembly.

* * * * *